US011067103B2

(12) United States Patent
Fukuda et al.

(10) Patent No.: US 11,067,103 B2
(45) Date of Patent: Jul. 20, 2021

(54) HYDRAULIC SYSTEM FOR WORKING MACHINE

(71) Applicant: KUBOTA CORPORATION, Osaka (JP)

(72) Inventors: Yuji Fukuda, Osaka (JP); Tsuyoshi Matsumoto, Osaka (JP); Ryosuke Kinugawa, Osaka (JP); Jun Tomita, Osaka (JP); Nozomu Minagawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/149,489

(22) Filed: Oct. 2, 2018

(65) Prior Publication Data

US 2019/0100900 A1 Apr. 4, 2019

(30) Foreign Application Priority Data

Oct. 3, 2017 (JP) ..... JP2017-193606

(51) Int. Cl.
*F15B 13/043* (2006.01)

(52) U.S. Cl.
CPC ..... *F15B 13/0433* (2013.01)

(58) Field of Classification Search
CPC ..... F15B 13/0433
See application file for complete search history.

(56) References Cited

U.S. PATENT DOCUMENTS 6,915,631 B2 * 7/2005 Kado ..... F16H 61/438 60/394

FOREIGN PATENT DOCUMENTS

JP 8-210305 A 8/1996
JP 2013-36276 2/2013

* cited by examiner

*Primary Examiner* — F Daniel Lopez
(74) *Attorney, Agent, or Firm* — Greenblum & Bernstein, P.L.C.

(57) ABSTRACT

A hydraulic system for a working machine, includes a hydraulic device to change a flow rate of an operation fluid. The hydraulic device includes a first hydraulic receiver to which the operation fluid is applied, a second hydraulic receiver to which the operation fluid is applied, and a movable portion to be moved by the operation fluid applied to any one of the first hydraulic receiver and the second hydraulic portion. A hydraulic system further includes a differential pressure regulator to supply the operation fluid to the first hydraulic receiver and the second hydraulic receiver, the differential pressure regulator being configured to regulate a differential pressure between a first pressure that is a pressure of the operation fluid applied to the first hydraulic receiver and a second pressure that is a pressure of the operation fluid applied to the second hydraulic receiver.

7 Claims, 11 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-193606, filed Oct. 3, 2017. The contents of this application is incorporated herein by reference in their entirety.

BACKGROUND OF THE INVENTION

Field of the Invention

The present invention relates to a hydraulic system for a working machine.

Description of Related Art

Japanese Unexamined Patent Publication No. 2013-36276 is previously known as a hydraulic system for a working machine such as a skid steer loader and a compact track loader.

The hydraulic system disclosed in Japanese Unexamined Patent Publication No. 2013-36276 has an HST motor configured to be switched between a low speed (a first speed) and a high speed (a second speed), a hydraulic switching valve configured to switch the HST motor between the first speed or the second speed, and a direction switching valve configured to switch over the hydraulic switching valve. In addition, the hydraulic system also includes an HST pump configured to change an angle of a swash plate due to an operation of the traveling lever and to change a supply amount of the hydraulic fluid to the HST motor in response to the angle of the swash plate.

SUMMARY OF THE INVENTION

A hydraulic system for a working machine, includes a hydraulic device to change a flow rate of an operation fluid. The hydraulic device includes a first hydraulic receiver to which the operation fluid is applied, a second hydraulic receiver to which the operation fluid is applied, and a movable portion to be moved by the operation fluid applied to any one of the first hydraulic receiver and the second hydraulic portion. A hydraulic system further includes a differential pressure regulator to supply the operation fluid to the first hydraulic receiver and the second hydraulic receiver, the differential pressure regulator being configured to regulate a differential pressure between a first pressure that is a pressure of the operation fluid applied to the first hydraulic receiver and a second pressure that is a pressure of the operation fluid applied to the second hydraulic receiver.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
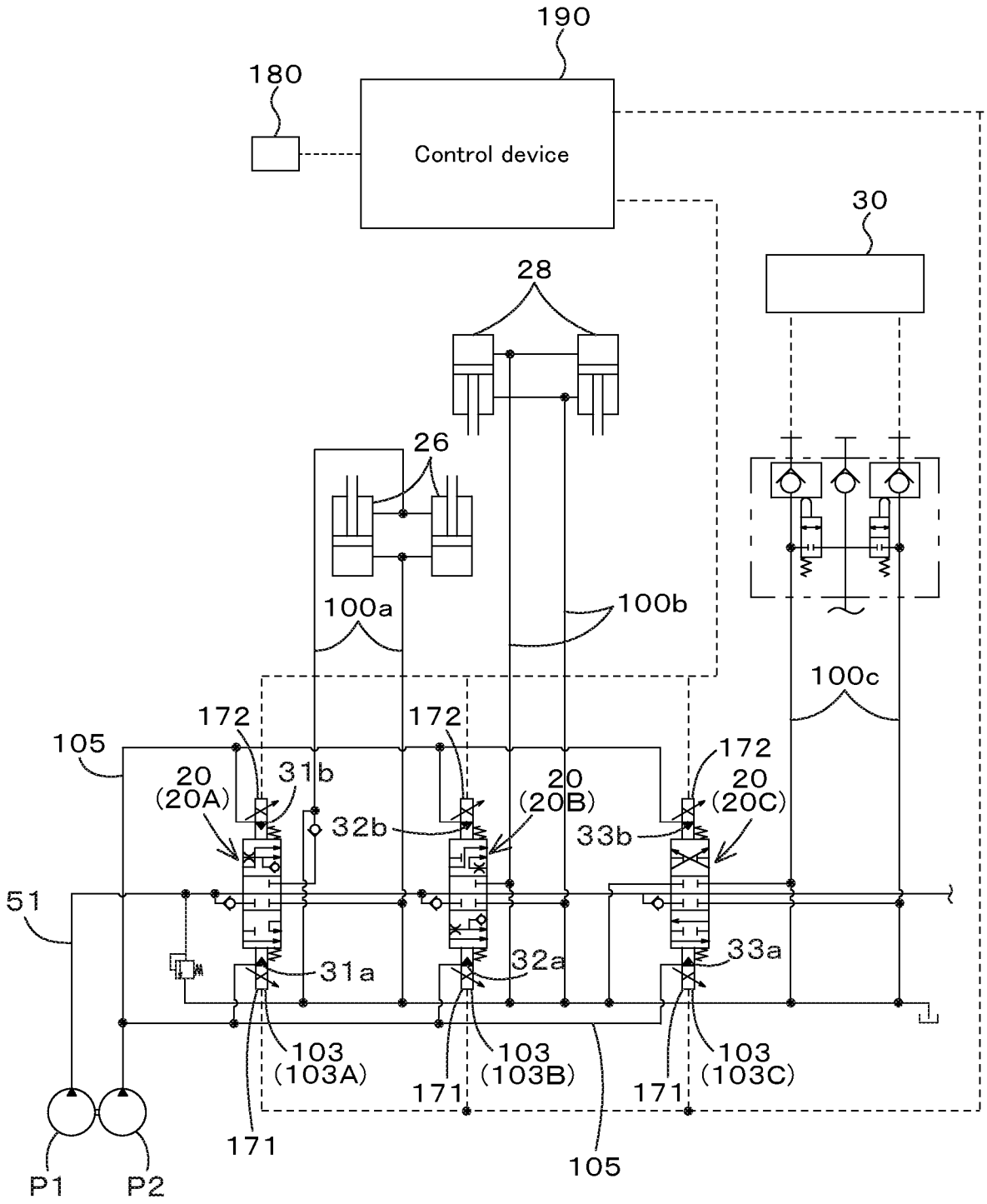
FIG. 1 is a view illustrating a hydraulic system for a working system according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Hereinafter, a hydraulic system for a working machine according to embodiments of the present invention will be described with reference to the drawings.

First Embodiment

Figure 7:
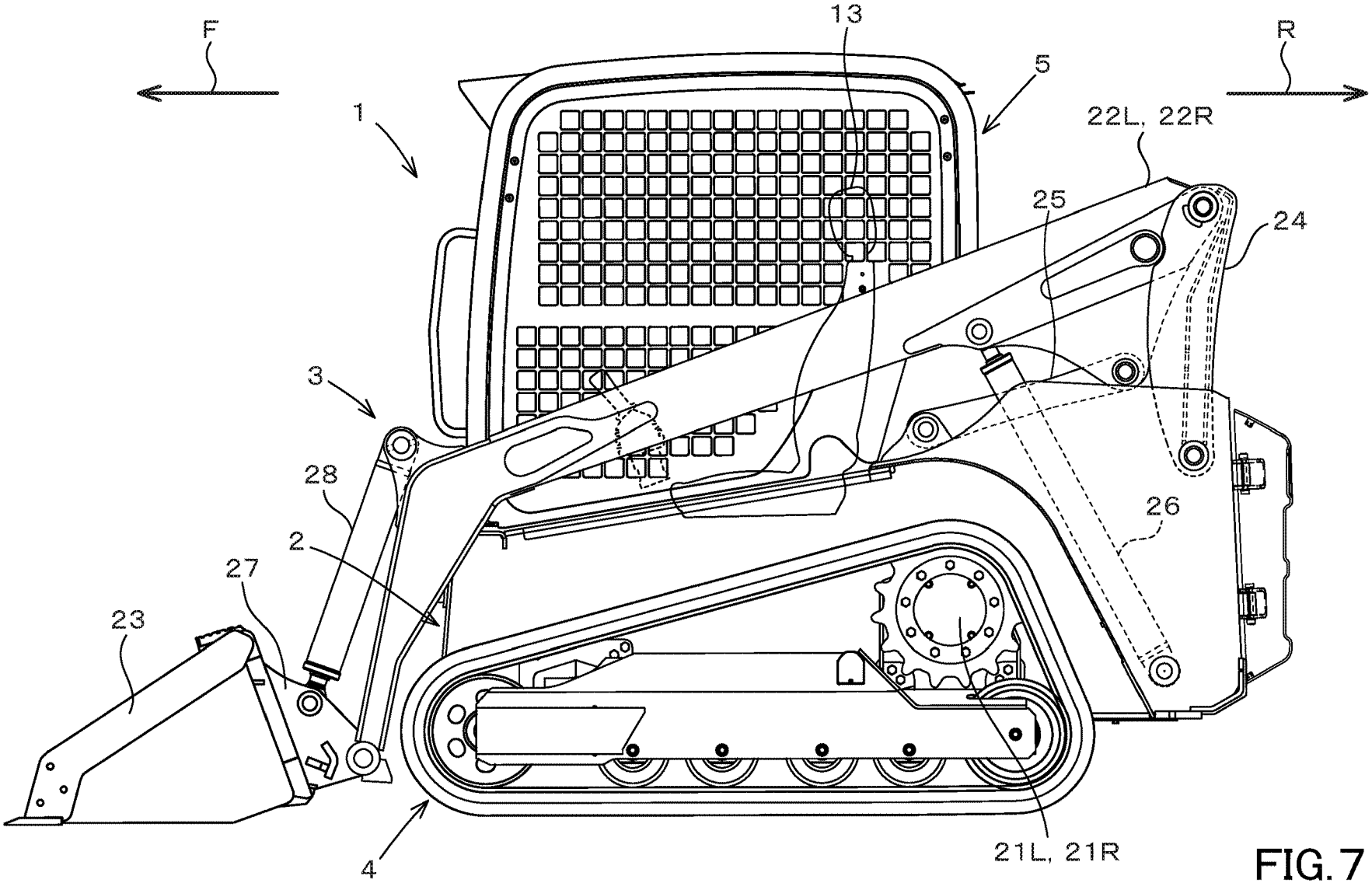
FIG. 7 is a side view illustrating a track loader according to the embodiments.
Figure 8:
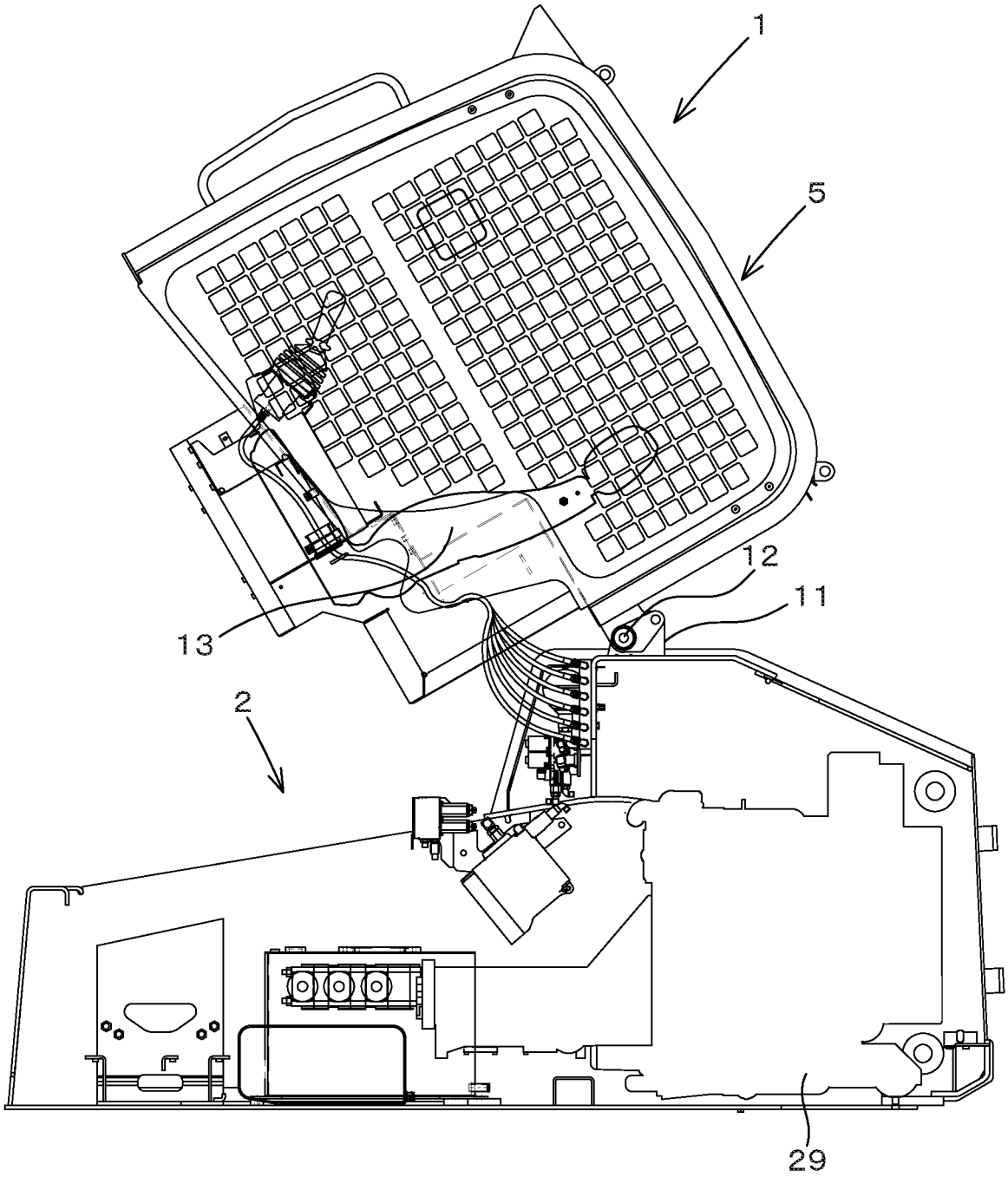
FIG. 8 is a side view of the track loader lifting up a cabin according to the embodiments.

The overall configuration of the working machine will be described. FIG. 7 and FIG. 8 show a track loader as an example of the working machine 1. The working machine 1 is not limited to the track loader, but may be a tractor, a skid steer loader, a compact track loader, a backhoe, or the like.

In the embodiment, a front side (a direction indicated by an arrowed line F in FIG. 7) of an operator seated on the operator seat of the working machine 1 is defined as the front. A rear side (a direction indicated by an arrowed line R in FIG. 7) of the operator is defined as the rear. A left side (a front surface side of the sheet of FIG. 7) of the operator is defined as the left. And, a right side (a back surface side of the sheet of FIG. 7) of the operator is defined as the right.

As shown in FIG. 7 and FIG. 8, the working machine 1 includes a machine body 2, a working device 3 attached to the machine body 2, and a traveling device 4 supporting the machine body 2. A cabin 5 is mounted on an upper portion of the machine body 2 in front of the machine body 2.

The rear portion of the cabin 5 is supported by a support bracket 11 of the machine body 2, and is configured to be freely swung around the support shaft 12. The front portion of the cabin 5 is configured to be supported by the front portion of the machine body 2. An operator seat 13 is provided in the cabin 5.

The traveling device 4 is constituted of a crawler traveling hydraulic device. The traveling device 4 is provided below the left side of the machine body 2, and another traveling device 4 is provided below the right side of the machine body 2.

The working device 3 includes a boom 22L, a boom 22R, and a bucket 23 (an working tool) attached to the tips of the boom 22L and the boom 22R. The boom 22L is arranged on the left side of the machine body 2. The boom 22R is arranged on the right side of the machine body 2.

The boom 22L and the boom 22R are connected to each other by a connecting member (not shown in the drawings) provided between the boom 22L and the boom 22R. The boom 22L and the boom 22R are respectively supported by the first lift link 24 and the second lift link 25.

Between the base portion sides of the boom 22L and the boom 22R and the rear lower portion of the machine body 2, a boom cylinder 26 constituted of a double acting hydraulic cylinder is provided corresponding to the boom 22L and the boom 22R.

Stretching and shortening of the boom cylinders 26 cause the boom 22L and the boom 22R to swing up and down simultaneously.

An attachment bracket 27 is pivotally connected to the tip end side of the boom 22L, and another attachment bracket 27 is pivotally connected to the tip end side of the boom 22R. The attachment brackets 27 are rotatable about a transverse axis. The back side of the bucket 23 is attached to the attachment bracket 27.

A bucket cylinder 28 constituted of the double acting hydraulic cylinder is provided between the attachment bracket 27 and the middle portions of the distal end sides of the boom 22L and the boom 22R, corresponding to the boom 22L and the boom 22R.

The bucket 23 performs a swing operation (a shoveling operation/a dumping operation) due to stretching and shortening of the bucket cylinder 28.

The bucket 23 is attachable to and detachable from the attachment bracket 27. Various types of attachments (a working tool of a hydraulically-driven type having a hydraulic actuator) can be attached to the attachment bracket 27 when the bucket 23 is detached. In this manner, the attachment bracket 27 is configured to perform various types of workings other than excavation (or another excavation working).

Next, the hydraulic system for the working machine will be explained. FIG. 1 is a view showing a hydraulic system of a working system for the working machine.

As shown in FIG. 1, the hydraulic system includes a first hydraulic pump P1 and a second hydraulic pump P2. The first hydraulic pump P 1 is used for driving the boom cylinder 26, the bucket cylinder 28, or a hydraulic actuator of the attachment attached to the tip end side of the boom 22.

The second hydraulic pump P2 (a pilot pump, a charge pump) is mainly used for supplying a hydraulic fluid pressure serving as a control pressure or a signal pressure. Hereinafter, for convenience of the explanation, the hydraulic fluid servings the control pressure or the signal pressure will be referred to as "a pilot fluid", and a pressure of the pilot fluid will be referred to as "a pilot pressure".

In addition, the hydraulic system of the working system includes a plurality of hydraulic devices. The plurality of hydraulic devices are control valves configured to change a flow rate or a pressure of the hydraulic fluid to be supplied to the hydraulic actuator. In the embodiment, a switching valve (a flow rate control valve) 20 is employed as the control valve, the switching valve being configured to change the flow rate of the hydraulic fluid in accordance with change of positions.

The plurality of switching valves 20 include the boom switching valve 20A, the bucket switching valve 20B, and the auxiliary switching valve 20C.

The boom switching valve 20A is a valve configured to control a hydraulic actuator (a boom cylinder) 26 that moves the boom 22L and the boom 22R. The boom switching valve 20A is constituted of a three-position switching valve of a direct-acting spool type (a direct-acting spool type three-position switching valve).

The bucket switching valve 20B is a valve configured to control a hydraulic cylinder (a bucket cylinder) 28 that controls movement of the bucket 23. The bucket switching valve 20B is constituted of a three-position switching valve of a pilot direct-acting spool type (a pilot direct-acting spool type three-position switching valve).

The auxiliary switching valve 20C is constituted of a valve configured to control a hydraulic actuator (a hydraulic cylinder, a hydraulic motor, and the like) 30 that is attached to the auxiliary attachment. The auxiliary switching valve 20C is constituted of a three-position switching valve of a pilot direct-acting spool type (a pilot type direct-acting spool type three-position switching valve).

The first hydraulic pump P1 and the plurality of switching valves 20 (the boom switching valve 20A, the bucket switching valve 20B, and the auxiliary switching valve 20C) are connected to each other by an output fluid tube 51.

The plurality of switching valves 20 and the hydraulic actuators 26, 28, and 30 are respectively connected to each other by a third fluid tube.

The third fluid tube includes fluid tubes 100*a*, 100*b*, and 100*c*. The fluid tube 100*a* connects the hydraulic actuator 26 and the boom switching valve 20A to each other. The fluid tube 100*b* connects the hydraulic actuator 28 and the bucket switching valve 20B to each other. The fluid tube 100*c* connects the hydraulic actuator 30 and the auxiliary switching valve 20C to each other.

The hydraulic device will be described in detail, exemplifying the boom switching valve 20A, the bucket switching valve 20B, and the auxiliary switching valve 20C.

Figure 2:
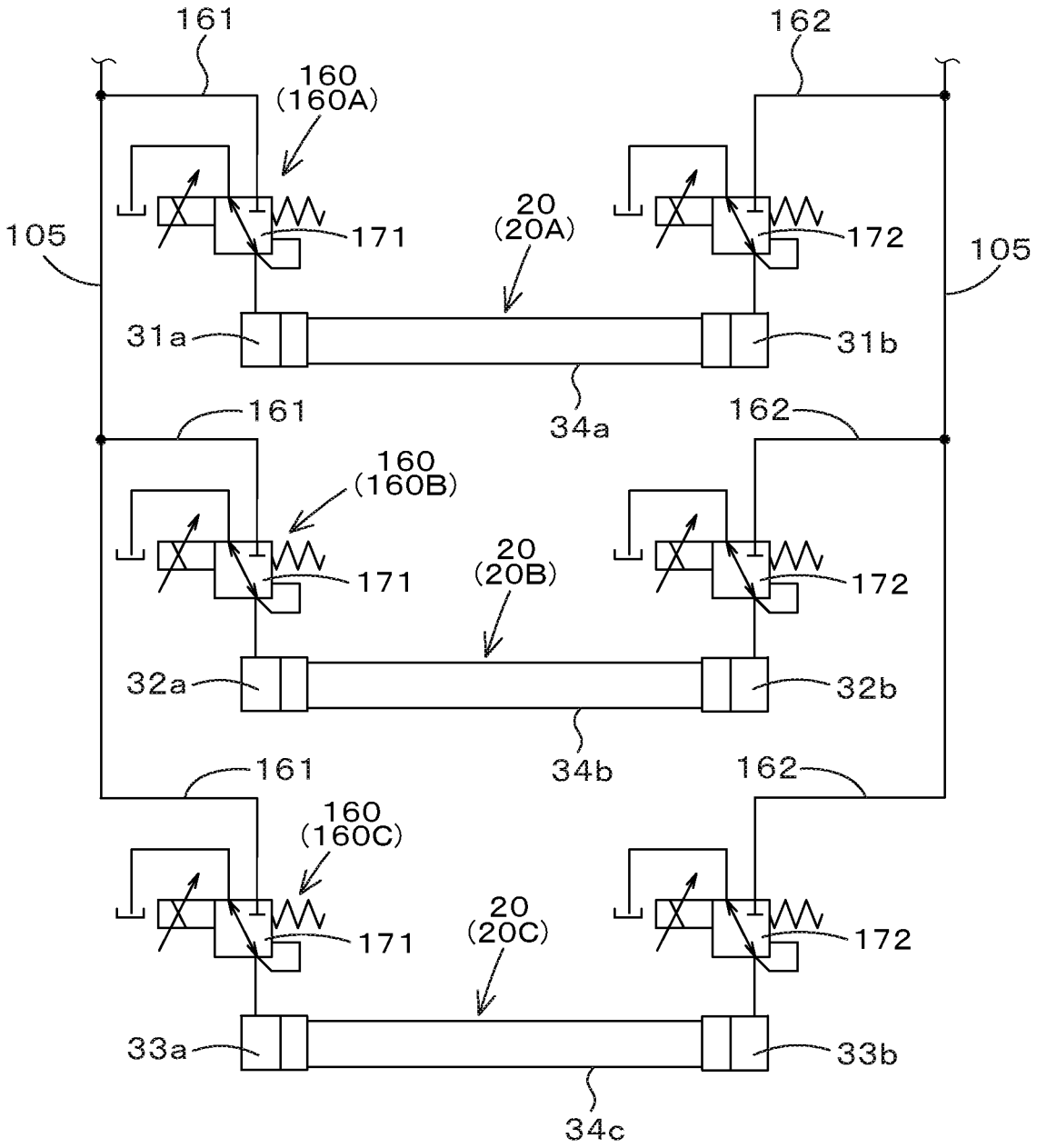
FIG. 2 is a view illustrating a relation between a first fluid tube, a proportional valve, and a hydraulic receiving portion according to the first embodiment.

As shown in FIG. 1 and FIG. 2, the boom switching valve 20A includes a first hydraulic receiving portion (a first hydraulic receiver) 31*a*, a second hydraulic receiving portion (a second hydraulic receiver) 31*b*, and a movable portion 34*a*.

The first hydraulic receiving portion 31*a* is provided in a main body of the boom switching valve 20A, and is a portion to which the pilot pressure is applied when the pilot fluid is supplied.

The second hydraulic receiving portion 31*b* is provided in the main body of the boom switching valve 20A, and is a portion to which the pilot pressure is applied when the pilot fluid is supplied.

The movable portion 34*a* is a spool configured to be moved by the pilot fluid, and is provided movably in the main body. The first hydraulic receiving portion 31*a* is arranged on one side of the movable portion 34*a* in the longitudinal direction. The second hydraulic receiving portion 31*b* is arranged on the other side of the movable portion 34*a* in the longitudinal direction.

The bucket switching valve 20B includes a first hydraulic receiving portion (a first hydraulic receiver) 32*a*, a second hydraulic receiving portion (a second hydraulic receiver) 32*b*, and a movable portion 34*b*.

The first hydraulic receiving portion 32*a* is provided in the main body of the bucket switching valve 20B. The first hydraulic receiving portion 32*a* is a portion to which the pilot pressure is applied when the pilot fluid is supplied. The second hydraulic receiving portion 32*b* is provided in the main body of the bucket switching valve 20B. The second hydraulic receiving portion 32*b* is a portion to which the pilot pressure is applied when the pilot fluid is supplied.

The movable portion 34*b* is constituted of a spool configured to be moved by the pilot fluid. The movable portion 34*b* is provided inside the main body and is movable in the main body. On one side of the movable portion 34*b* in the longitudinal direction, the first hydraulic receiving portion 32*a* is arranged. On the other side of the movable portion 34*b* in the longitudinal direction, the second hydraulic receiving portion 32*b* is arranged.

The auxiliary switching valve 20C includes a first hydraulic receiving portion (a first hydraulic receiver) 33*a*, a second hydraulic receiving portion (a second hydraulic receiver) 33*b*, and a movable portion 34*c*.

The first hydraulic receiving portion 33*a* is provided in the main body of the auxiliary switching valve 20C. The first hydraulic receiving portion 33*a* is a portion to which the pilot pressure is applied when the pilot fluid is supplied. The second hydraulic receiving portion 33*b* is provided in the main body of the auxiliary switching valve 20C. The second hydraulic receiving portion 33*b* is a portion to which the pilot pressure is applied when the pilot fluid is supplied.

The movable portion 34*c* is constituted of a spool configured to be moved by the pilot fluid. The movable portion 34*c* is provided inside the main body and is movable in the main body. The first hydraulic receiving portion 33*a* is arranged on one side of the movable portion 34*c* in the longitudinal direction. On the other side of the movable portion 34*c* in the longitudinal direction, the second hydraulic receiving portion 33*b* is arranged.

The hydraulic system of the working system includes a plurality of differential pressure regulation devices (differential pressure regulators) 160. Each of the plurality of differential pressure regulation devices 160 includes a differential pressure regulation device (a differential pressure regulator) 160A corresponding to the boom switching valve 20A, a differential pressure regulation device (a differential pressure regulator) 160B corresponding to the bucket switching valve 20B, and a differential pressure regulation device (a differential pressure regulator) 160C corresponding to the auxiliary switching valve 20C.

The differential pressure regulation device 160A is configured to supply the pilot fluid to the first hydraulic receiving portion 31*a* and the second hydraulic receiving portion 31*b*. In addition, the differential pressure regulation device 160A sets a differential pressure at least between the pilot pressure (a first pressure AP1) of the pilot fluid applied to the first hydraulic receiving portion 31*a* and the pilot pressure (a second pressure AP2) of the pilot fluid applied to the second hydraulic receiving portion 31*b*.

The differential pressure regulation device 160B is configured to supply the pilot fluid to the first hydraulic receiving portion 32*a* and the second hydraulic receiving portion 32*b*. In addition, the differential pressure regulation device 160B sets a differential pressure at least between the pilot pressure (a first pressure BP1) of the pilot fluid applied to the first hydraulic receiving portion 32*a* and the pilot pressure (a second pressure BP2) of the pilot fluid applied to the second hydraulic receiving portion 32*b*.

The differential pressure regulation device 160C is configured to supply the pilot fluid to the first hydraulic receiving portion 33*a* and the second hydraulic receiving portion 33*b*. In addition, the differential pressure regulation device 160C sets a differential pressure at least between the pilot pressure (a first pressure CP1) of the pilot fluid applied to the first hydraulic receiving portion 33*a* and the pilot pressure (a second pressure CP2) of the pilot fluid applied to the second hydraulic receiving portion 33*b*.

Hereinafter, the differential pressure regulation device will be described, taking the differential pressure regulation device 160A as an example.

The flow rate control valve corresponding to the differential pressure regulation device 160A is different from the flow rate control valve corresponding to the differential pressure regulation device 160B and from the flow rate control valve corresponding to the differential pressure regulation device 160C. However, the descriptions of the differential pressure regulation device 160B and the differential pressure regulation device 160C are given by replacing the differential pressure regulation device 160A with the differential pressure regulation device 160B and the differential pressure regulation device 160C in the explanation of the differential pressure regulation device 160A described below.

The differential pressure regulation device 160A includes a first fluid tube 161, a second fluid tube 162, a first proportional valve 171, and a second proportional valve 172.

The first fluid tube 161 is a fluid tube connected to the first hydraulic receiving portion 31*a* of the boom switching valve 20A. The second fluid tube 162 is a fluid tube connected to the second hydraulic receiving portion 31*b* of the boom switching valve 20A. The first fluid tube 161 and the second fluid tube 162 are also connected to the fluid tube 105 connected to the second hydraulic pump P2.

Thus, the pilot fluid outputted from the second hydraulic pump P2 can be supplied to the first hydraulic receiving portion 31*a* and the second hydraulic receiving portion 31*b* of the boom switching valve 20A through the first fluid tube 161 and the second fluid tube 162.

The first proportional valve 171 is constituted of an electromagnetic proportional valve provided in the first fluid tube 161. The degree of opening aperture of the first proportional valve 171 can be changed. The second proportional valve 172 is constituted of an electromagnetic proportional valve provided in the second fluid tube 162. The degree of opening aperture of the second proportional valve 172 can be changed.

Thus, when the opening aperture of the first proportional valve 171 is changed, the pilot pressure applied to the first hydraulic receiving portion 31*a* of the boom switching valve 20A can be set (regulated). In addition, when the opening aperture of the second proportional valve 172 is changed, the pilot pressure applied to the first hydraulic receiving portion 31*a* of the boom switching valve 20A can be set (regulated).

Hereinafter, the pilot pressure applied to the first hydraulic receiving portion 31*a* is referred to as "a first pressure". In addition, the pilot pressure applied to the second hydraulic receiving portion 31*b* is referred to as "a second pressure". A difference between the first pressure and the second pressure is referred to as "a differential pressure".

The first proportional valve 171 and the second proportional valve 172 set the first pressure and the second pressure based on the operation of the operation member 180. The operation member 180 is constituted of a swingable lever, a slideable slide switch, a pushable push switch, or the like. The operation member 180 is provided in the vicinity of the operator seat 13, and can be operated by an operator (a driver).

The operation member 180 is a member for operating the booms 22L and 22R (the boom cylinders 26).

When the operation member 180 is operated in one direction from the neutral position, the opening aperture of the first proportional valve 171 increases in accordance with the operation amount (an operation extent) of the operation member 180.

In addition, when the operation member 180 is operated in the other direction from the neutral position, the opening aperture of the second proportional valve 172 increases in accordance with the operation amount (the operation extent) of the operation member 180.

Further, when the operation member 180 is operated to the neutral position from the maximum position in one direction, the opening aperture of the first proportional valve 171 decreases in accordance with the operation amount (the operation extent) of the operation member 180.

Moreover, when the operation member 180 is operated to the neutral position from the maximum position in the other direction, the opening aperture of the second proportional valve 172 decreases in accordance with the operation amount (the operation extent) of the operation member 180.

Thus, it is possible to change the degrees of opening apertures of the first proportional valve 171 and the second proportional valve 172 with the operation of the operation member 180, and thereby it is possible to set the first pressure and the second pressure.

In this manner, the boom switching valve 20A is switched by changing the opening apertures of the first proportional valve 171 and the second proportional valve 172.

Figure 3A:
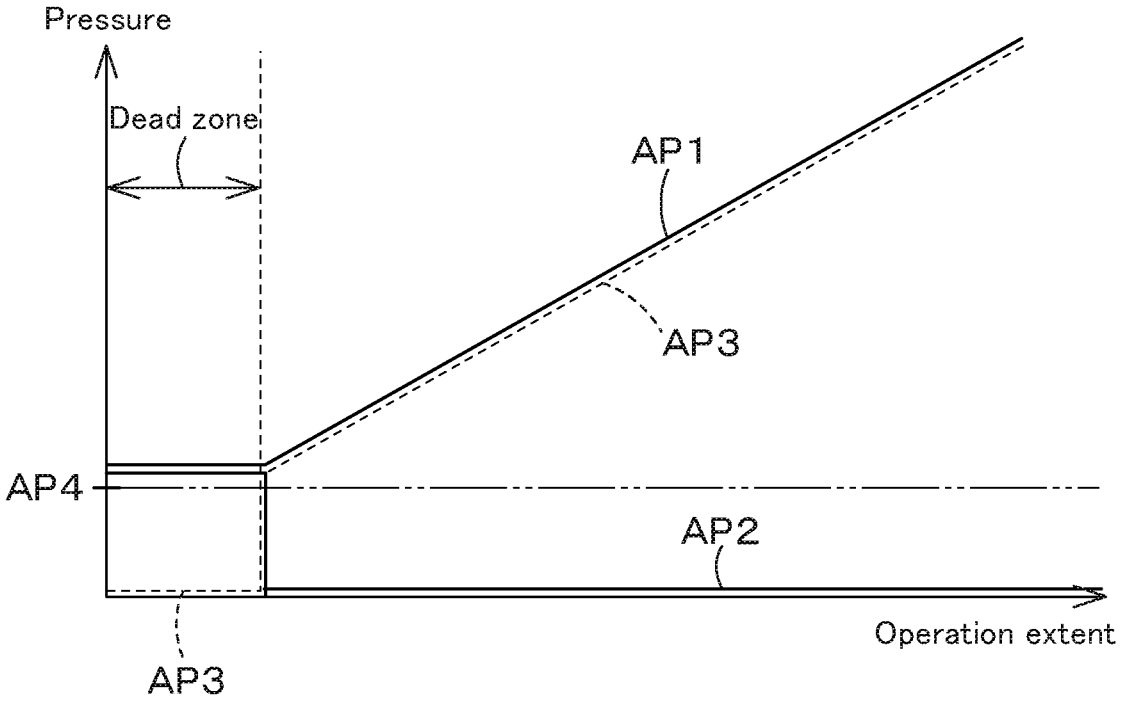
FIG. 3A is a view illustrating a relation between a first pressure AP1, a second pressure AP2, a differential pressure AP3, and a required pressure AP4 in a case where an operation member is operated from a neutral position to one side according to the first embodiment.
Figure 3B:
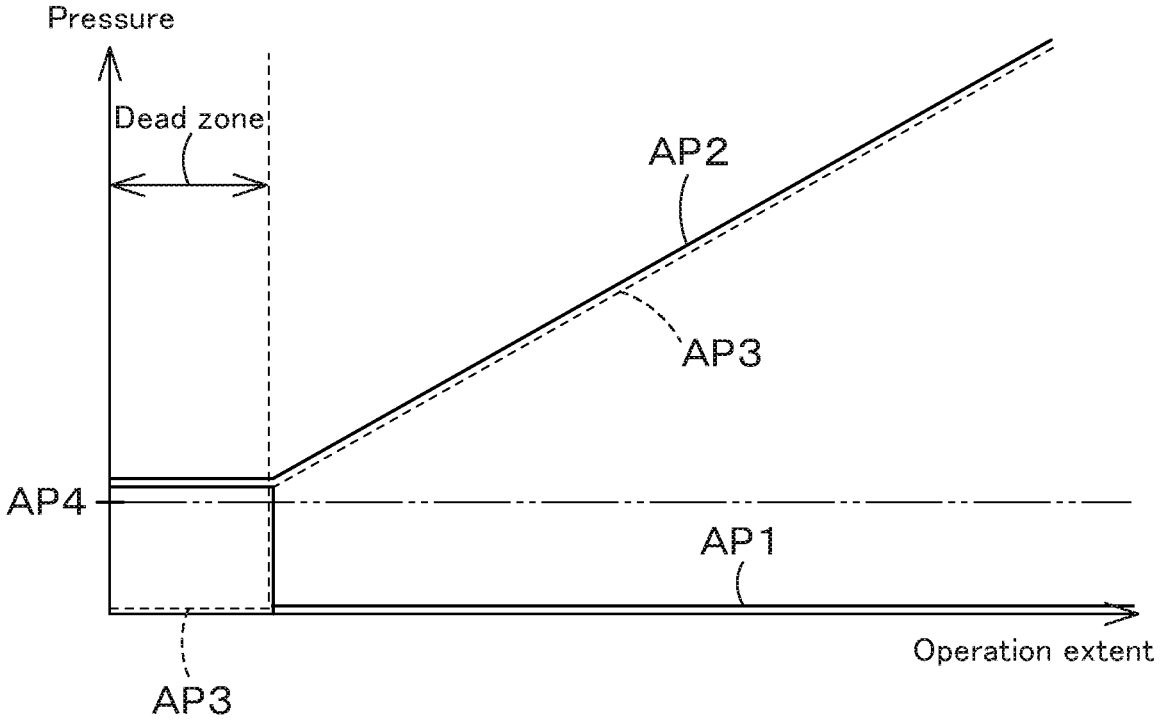
FIG. 3B is a view illustrating a relation between the first pressure AP1, the second pressure AP2, the differential pressure AP3, and the required pressure AP4 in a case where the operation member is operated from the neutral position to the other side according to the first embodiment.

FIG. 3A and FIG. 3B are diagrams showing a relationship between the operation extent of the operation member 180, the first pressure, the second pressure, and the differential pressure.

As shown in FIG. 3A and FIG. 3B, In the case where the operation extent of the operation member 180 is zero when the operation member 180 is not operated, the first proportional valve 171 and the second proportional valve 172 move to change the first pressure AP1 and the second pressure AP2 to be substantially equal to each other, and thereby the differential pressure AP3 is set to substantially zero.

The first proportional valve 171 and the second proportional valve 172 maintain the differential pressure AP3 at substantially zero until the operation extent of the operation member 180 exceeds a predetermined extent or more from zero, that is, exceeds the dead zone.

When the operation member 180 is operated and the operation extent exceeds the dead zone, either one of the first proportional valve 171 or the second proportional valve 172 decreases either one of the first pressure AP1 and the second pressure AP2.

That is, in the case where the operation member 180 is operated and the operation extent exceeds the dead zone, either one of the first proportional valve 171 and the second proportional valve 172 sets the differential pressure AP3 to be equal to or higher than a required pressure AP4. The required pressure AP4 is a pressure defining the minimum differential pressure AP3 between the first pressure AP1 and the second pressure AP2, which is required for the movement of the movable portion (the spool) 34*a*.

That is, the required pressure AP4 is a pressure defining the minimum differential pressure AP3 required for moving the movable portion (the spool) 34*a* to one side or the other side by the pilot pressure, and thereby switching the boom switching valve 20A.

That is, the required pressure AP4 is a pilot pressure defining the minimum differential pressure AP3 between the first pressure AP1 and the second pressure AP2, which is necessary for switching the boom switching valve 20A from the neutral position 21*c* to the first position 21*a* and/or to the second position 21*b* in the case where the boom switching valve 20A is constituted of a three-position switching valve.

For example, under the state where the operation member 180 is not operated, that is, when the operation extent of the operation member 180 is less than the predetermined extent, the first proportional valve 171 and the second proportional valve 172 hold the first pressure AP1 and the second pressure AP2 to be equal to or higher than the required pressure AP4.

Here, when the operation member 180 is operated and the operation extent exceeds the dead zone, either one of the first proportional valve 171 and the second proportional valve 172 sets the first pressure AP1 or the second pressure AP2 to substantially zero. In this manner, the differential pressure AP3 is set to be equal to or higher than the required pressure AP4.

More specifically, in the case where the operation member 180 is at the neutral position, both of the first proportional valve 171 and the second proportional valve 172 set opening apertures thereof corresponding to the required pressure AP4 or more.

As shown in FIG. 3A, in the case where the operation member 180 is operated from the neutral position in one direction, the first proportional valve 171 increases the opening aperture in accordance with the operation extent when exceeding the dead zone, and the second proportional valve 172 decreases the opening aperture to zero. In this manner, the differential pressure AP3 is set to be equal to or higher than the required pressure AP4.

As shown in FIG. 3B, in the case where the operation member 180 is operated from the neutral position in the other direction, the first proportional valve 171 reduces the opening aperture to zero, and the second proportional valve 172 increases the opening aperture in accordance with the operation extent. In this manner, the differential pressure AP3 is set to be equal to or higher than the required pressure AP4.

That is, under the state where the operation member 180 is not operated, the first proportional valve 171 and the second proportional valve 172 apply a pressure to the first hydraulic receiving portion 31*a* and the second hydraulic receiving portion 31*b* of the boom switching valve 20A. In the case where the operation member 180 is operated, the first proportional valve 171 and the second proportional valve 172 reduce the pressure applied to the hydraulic receiving portion which is not the operation target.

Figure 4A:
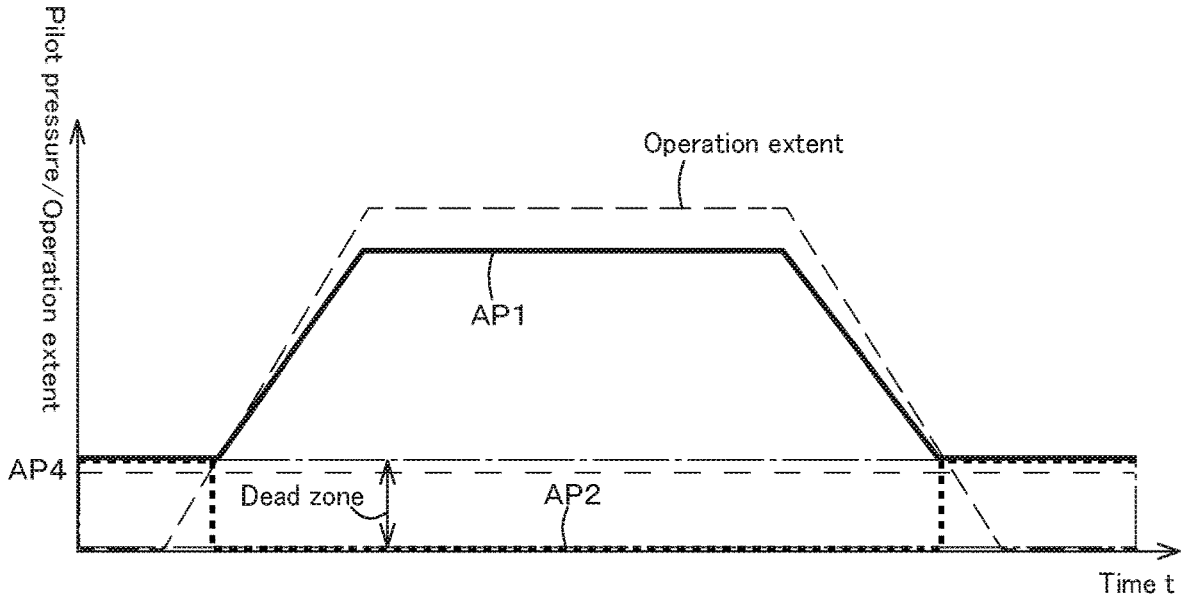
FIG. 4A is a view illustrating a relation between the first pressure AP1, the second pressure AP2, the differential pressure AP3, and the required pressure AP4 in a case where the operation member is operated to be shuttled in a direction according to the first embodiment.

In addition, as shown in FIG. 4A, under a situation where the operation member 180 is being operated to one side, for example, under a situation where the operation extent exceeds the dead zone and is the maximum, the first proportional valve 171 decreases the opening aperture in accordance with the operation extent when the operation extent of the operation member 180 is decreased.

Here, in the case where the operation extent of the operation member 180 reaches the dead zone, the first proportional valve 171 sets the opening aperture corresponding to the required pressure AP4 or more. In addition, the second proportional valve 172 sets the opening aperture in the dead zone region to an opening aperture corresponding to equal to or higher than the required pressure AP4.

Figure 4B:
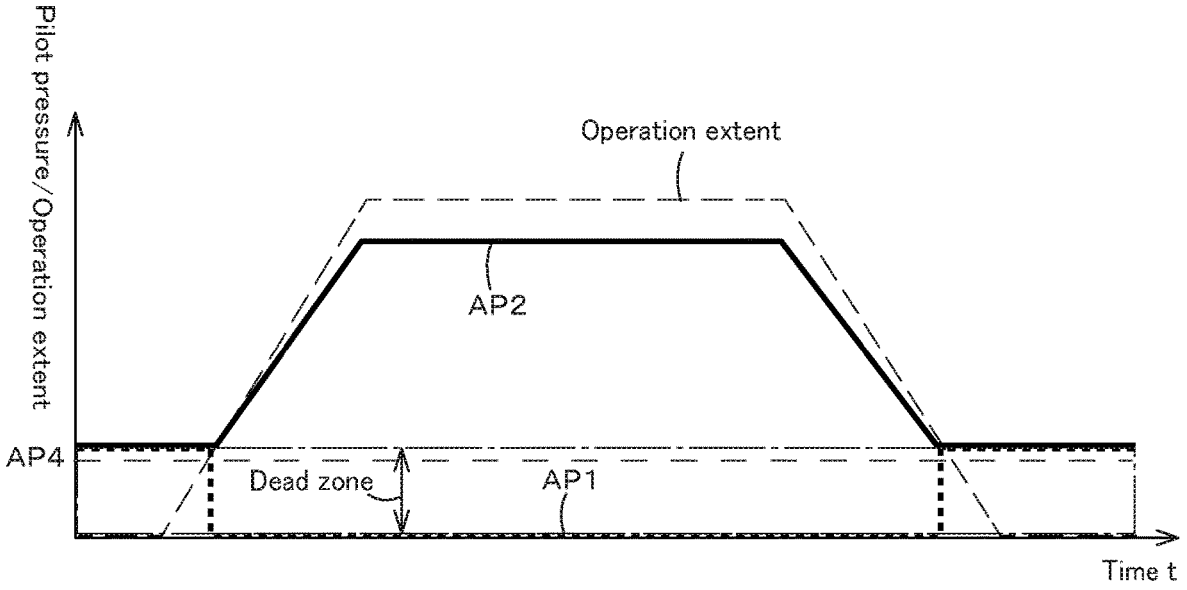
FIG. 4B is a view illustrating a relation between the first pressure AP1, the second pressure AP2, the differential pressure AP3, and the required pressure AP4 in a case where the operation member is operated to be shuttled in another direction according to the first embodiment.

In addition, as shown in FIG. 4B, under a situation where the operation member 180 is being operated to the other side, for example, under a situation where the operation extent is the maximum exceeding the dead zone, the second proportional valve 172 decreases the opening aperture in accordance with the operation extent when the operation extent of the operation member 180 is decreased.

In the case where the operation extent of the operation member 180 reaches the dead zone region, the first proportional valve 171 sets the opening aperture corresponding to the required pressure AP4 or more. In addition, the second proportional valve 172 sets the degree of opening aperture in the dead zone to the opening aperture corresponding to the required pressure AP4 or more.

In the above-described embodiment, the first proportional valve 171 and the second proportional valve 172 are set to the opening apertures corresponding to the required pressure AP4 or more under the state where the operation member 180 is not operated. Alternatively, the first proportional valve 171 and the second proportional valve 172 may be set to the opening apertures corresponding to the required pressure AP4 or less under the state where the operation member 180 is not operated. In addition, the first proportional valve 171 and the second proportional valve 172 may change the degree of opening aperture at least when the operation extent of the operation member 180 exceeds the dead zone, and may change the differential pressure AP3 to the required pressure AP4 or more.

Figure 5A:
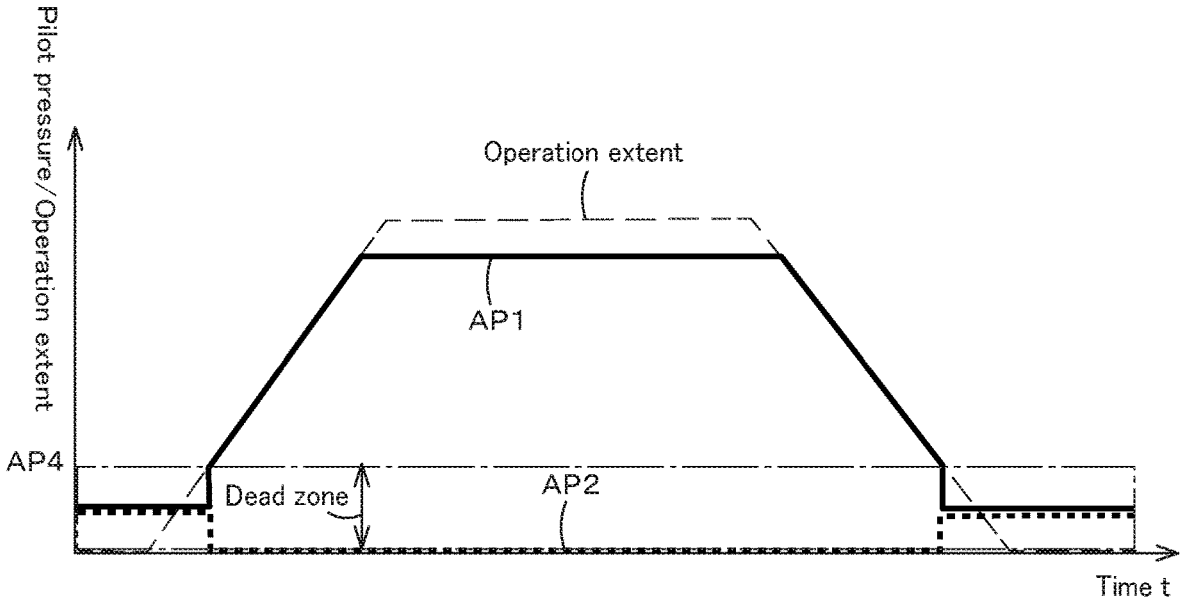
FIG. 5A is a view illustrating a pressure variation in the case where the operation member is operated to be shuttled in one direction according to the first embodiment, especially in a case where the required pressure is less than required pressure AP4 in a range of a dead band.
Figure 5B:
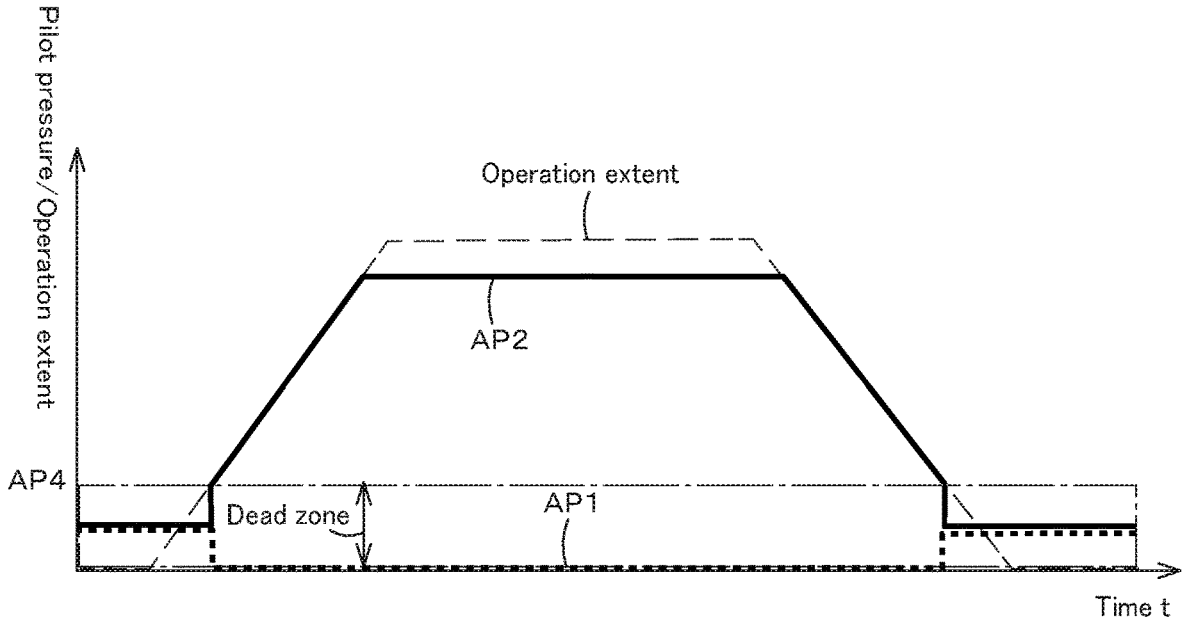
FIG. 5B is a view illustrating a pressure variation in the case where the operation member is operated to be shuttled in the other direction according to the first embodiment, especially in the case where the required pressure is less than required pressure AP4 in a range of a dead band.

As shown in FIG. 5A and FIG. 5B, in the case where the operation member 180 is in the neutral position, both of the first proportional valve 171 and the second proportional valve 172 set an opening aperture corresponding to the required pressure AP4 or less.

As shown in FIG. 5A, in the case where the operation member 180 is operated from the neutral position in one direction, both of the first proportional valve 171 and the second proportional valve 172 keep the opening apertures corresponding to the required pressure AP4 or less in the region of the dead zone.

When the operation extent of the operation member 180 exceeds the dead zone, the first proportional valve 171 increases the opening aperture, and thereafter increases the opening aperture in accordance with the operation extent.

In addition, when the operation extent of the operation member 180 exceeds the dead zone, the second proportional valve 172 reduces the opening aperture to zero. In this manner, the differential pressure AP3 is set to be equal to or higher than the required pressure AP4.

As shown in FIG. 5B, in the case where the operation member 180 is operated from the neutral position in the other direction, both of the first proportional valve 171 and the second proportional valve 172 keep the opening apertures corresponding to the required pressure AP4 or less in the region of the dead zone.

In addition, when the operation extent of the operation member 180 exceeds the dead zone, the first proportional valve 171 decreases the opening aperture to zero, and the second proportional valve 172 increases the opening aperture. In this manner, the differential pressure AP3 is set to be equal to or higher than the required pressure AP4.

Preferably, the controls of the first proportional valve 171 and the second proportional valve 172 mentioned above are performed by the control device 190 constituted of a CPU or the like. The control device 190 stores data indicating the relationship between the operation extent of the operation member 180, the first pressure AP1, the second pressure AP2, the differential pressure AP3, and the required pressure AP4.

For example, the storage device 191 stores the control maps, the control tables, the calculation formula, and the like, which represent the relationships shown in FIG. 3A, FIG. 3B, FIG. 4A, FIG. 4B, FIG. 5A, FIG. 5B, and the like.

In the above-described embodiment, the relationship between the operation extent of the operation member 180 and the pressures (the first pressure AP1, the second pressure AP2, the differential pressure AP3, and the required pressure AP4) have been explained. However, the control device 190 may store the operation extent and pressure with use of other indicators (an opening aperture of the proportional valve, a control signal (an electric current)). In addition, the control device 190 may store control values and the like so that the above-described control is performed based on other indices.

The control device 190 is connected to the operation member 180. The control device 190 is configured to obtain the operation extent of the operation member 180, the operation direction of the operation member 180, and the like. The control device 190 controls the first proportional valve 171 and the second proportional valve 172 on the basis of the operation extent of the operation member 180.

That is, the control device 190 outputs a control signal (an electric current) to solenoids of the first proportional valve 171 and the second proportional valve 172 so that the relationship between the operation extent of the operation member 180 and the first pressure AP1, the second pressure AP2, the differential pressure AP3, and the required pressure AP4 can be satisfied.

The differential pressure regulation device 160A is configured to supply the hydraulic fluid to the first hydraulic receiving portion 31*a* and the second hydraulic receiving portion 31*b* of the boom switching valve 20A. In addition, the differential pressure regulation device 160A sets at least a differential pressure between the first pressure AP1 and the second pressure AP2.

According to that configuration, by adding the first pressure AP1 to the first hydraulic receiving portion 31*a* of the boom switching valve 20A and further by adding the second pressure AP2 to the second hydraulic receiving portion 31*b*, the differential pressure is set from a state where there is no differential pressure. In this manner, it is possible to quickly move the movable portion (the spool) 34*a* of the boom switching valve 20A.

That is, the boom 22L and the boom 22R can be moved quickly from the stopped state. In this manner, the operability of the working machine 1 can be improved.

The differential pressure regulation device 160A includes a first proportional valve 171 configured to set the first pressure AP1 and a second proportional valve 172 configured to set the second pressure AP2.

According to that configuration, by changing the degrees of opening apertures of the first proportional valve 171 and the second proportional valve 172, it is possible to quickly set the differential pressure that is the difference between the first pressure AP1 and the second pressure AP2. In this manner, the differential pressure is easily set.

In the case where the operation member 180 is operated, either one of the first proportional valve 171 and the second proportional valve 172 reduces either one of the first pressure AP1 and the second pressure AP2.

In particular, in the case where the operation member 180 is operated, either one of the first proportional valve 171 and the second proportional valve 172 sets the differential pressure AP3 between the first pressure AP1 and the second pressure AP2 to be equal to or higher than the required pressure. The required pressure is the pressure required for the movement of the movable portion (the spool) 34*a*.

According to that configuration, it is possible to increase the initial momentum of the spool 34*a*. In this manner, the spool 34*a* can be moved quickly at the time when the operation member 180 is operated.

Second Embodiment

Figure 6:
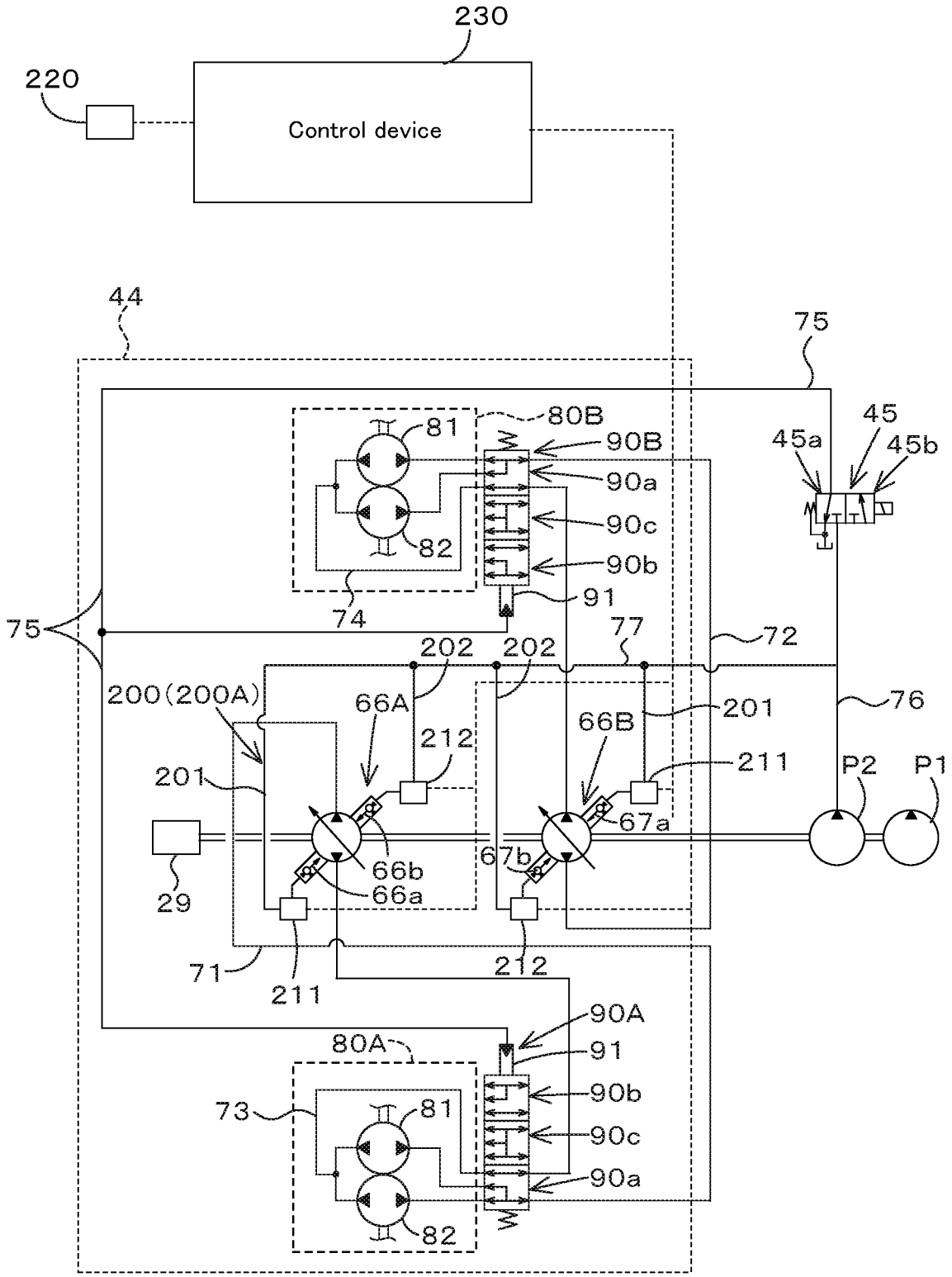
FIG. 6 is a view illustrating a hydraulic system for a traveling system according to a second embodiment of the present invention.

FIG. 6 is a diagram showing a hydraulic system of a traveling system for the working machine according to a second embodiment of the present invention. The hydraulic system of the traveling system can be applied to the work machine according to the first embodiment.

The hydraulic system of the traveling system shown in FIG. 6 includes a plurality of hydraulic devices. Each of the plurality of hydraulic devices is constituted of a hydraulic pump configured to change an angle of a swash plate. In this embodiment, a traveling hydraulic pump 66A and a traveling hydraulic pump 66B configured to supply the hydraulic fluid to the traveling motors (the first traveling motor 80A and the second traveling motor 80B) are employed as a hydraulic pump configured to change an angle of a swash plate.

The first traveling hydraulic pump 66A includes a first hydraulic receiving portion (a first hydraulic receiver) 66*a* to which the pilot pressure is applied and a second hydraulic receiving portion (a second hydraulic receiver) 66*b* to which the pilot pressure is applied. Each of the first hydraulic receiving portion 66*a* and the second hydraulic receiving portion 66*b* houses a cylinder for changing the angle of the swash plate. Hereinafter, the cylinder will be referred to as the movable portion.

The first hydraulic receiving portion 66*a* and the second hydraulic receiving portion 66*b* of the first traveling hydraulic pump 66A are connected to the first traveling motor 80A by a first circulating fluid tube 71. The first circulation fluid tube 71 is an fluid tube through which the hydraulic fluid is circulated.

The second traveling hydraulic pump 66B includes a first hydraulic receiving portion (a first hydraulic receiver) 67*a* to which the pilot pressure is applied and a second hydraulic receiving portion (a second hydraulic receiver) 67*b* to which the pilot pressure is applied. Each of the first hydraulic receiving portion 67*a* and the second hydraulic receiving portion 67*b* houses a cylinder for changing the angle of the swash plate. Hereinafter, the cylinder will be referred to as the movable portion.

The first hydraulic receiving portion 67*a* and the second hydraulic receiving portion 67*b* of the second traveling hydraulic pump 66B are connected to the second traveling motor 80B by a second circulating fluid tube 72. The second circulation fluid tube 72 is an fluid tube through which the hydraulic fluid is circulated.

The first hydraulic switching valve 90A and the first traveling motor 80A are connected to each other by an fluid tube 73. The second hydraulic switching valve 90B and the second traveling motor 80B are connected to each other by an fluid tube 74.

In addition, the first hydraulic pressure switching valve 90A, the second hydraulic pressure switching valve 90B, and the switching valve 45 are connected to each other by an fluid tube 75. The switching valve 45 and the second hydraulic pump P2 are connected to each other by an fluid tube 76.

Meanwhile, the first traveling hydraulic pump 66A and the second traveling hydraulic pump 66B are connected to the second hydraulic pump P2 by a fluid tube (not shown in the drawings). The hydraulic fluid outputted from the second hydraulic pump P2 is supplied to the first traveling hydraulic pump 66A and the second traveling hydraulic pump 66B.

The first traveling hydraulic pump 66A is constituted of a swash-plate type variable displacement axial pump configured to be driven by the power of the prime mover 29. The first traveling hydraulic pump 66A is configured to change the angle of the swash plate. In addition, the first traveling hydraulic pump 66A changes the output direction and the output amount of the operation fluid in accordance with the angle of the swash plate. In this manner, the first traveling hydraulic pump 66A changes the rotational output of the first travel motor 80A.

Meanwhile, the second traveling hydraulic pump 66B has the same configuration as that of the first traveling hydraulic pump 66A. When the angle of the swash plate of the second traveling hydraulic pump 66B is changed, the output direction and the output amount of the operation fluid is changed. In this manner, the second traveling hydraulic pump 66B changes the rotational output of the second travel motor 80B.

The first traveling motor 80A is constituted of a cam motor (a radial piston motor). The first traveling motor 80A is a variable displacement type capable of changing a size of the displacement (a motor displacement) at the time of the operation. The first traveling motor 80A is configured to change the rotation and torque of the output shaft by changing the motor displacement.

In particular, the first traveling motor 80A includes a first motor 81 and a second motor 82. The motor displacement of the first traveling motor 80A is increased by supplying the operation fluid to both of the first motor 81 and the second motor 82. In this manner, the first traveling motor 80A is set to the first speed.

In addition, the motor displacement of the first traveling motor 80A is reduced by supplying the operation fluid to either one of the first motor 81 and the second motor 82. In this manner, the first traveling motor 80 is set to the second speed. Meanwhile, the second traveling motor 80B has the same configuration as that of the first traveling motor 80A, and can be set to the first speed or the second speed.

The first hydraulic switching valve 90A is connected to the first traveling motor 80A. The first hydraulic pressure switching valve 90A is constituted of a hydraulic switching valve. The first hydraulic pressure switching valve 90A is a valve configured to be switched to a plurality of switching positions in accordance with the pilot pressure that is a pressure of the pilot fluid. The first hydraulic pressure switching valve 90A sets the first traveling motor 80A to the first speed or the second speed.

In particular, the first hydraulic switching valve 90A is constituted of a three-position switching valve configured to be switched to three positions, a first position 90*a*, a second position 90*b*, and a neutral position 90*c*.

Specifically, in the case where the pressure of the pilot fluid applied to the hydraulic receiving portion 91 of the first hydraulic switching valve 90A is less than the set pressure that is a predetermined pressure, the hydraulic switching valve 90 is held at the first position 90*a* by a spring.

In the case where the first hydraulic switching valve 90A is in the first position 90*a*, the operation fluid is supplied to both of the first motor 81 and the second motor 82. In this manner, the first traveling motor 80A is set to the first speed.

In the case where the pressure of the pilot fluid applied to the hydraulic receiving portion 91 of the first hydraulic switching valve 90A is equal to or higher than the set pressure, the first hydraulic switching valve 90A is switched to the second position 90*b* through the neutral position 90*c*.

In the case where the first hydraulic pressure switching valve 90A is in the second position 90*b*, the operation fluid is supplied only to the first motor 81. In this manner, the first traveling motor 80A is set to the second speed.

Meanwhile, the second hydraulic switching valve 90B is connected to the first traveling motor 80B. The second hydraulic switching valve 90B has the same configuration as that of the first hydraulic switching valve 90A. The second hydraulic switching valve 90B switches the second traveling motor 80B to the first speed or the second speed.

The switching valve 45 is connected to the first hydraulic switching valve 90A and the second hydraulic switching valve 90B. The switching valve 45 is, for example, a two-position switching valve configured to be switched between a first position 45*a* and a second position 45*b*. The switching valve 45 is a valve configured to switch the first hydraulic switching valve 90A and the second hydraulic switching valve 90B.

When the switching valve 45 is switched to the first position 45*a*, the first hydraulic switching valve 90A and the second hydraulic switching valve 90B are to the first position 90*a*. When the switching valve 45 is set to the second position 45*b*, the first hydraulic switching valve 90A and the second hydraulic switching valve 90B are switched to the second position 90*b* through the neutral position 90*c*.

That is, by switching the switching valve 45, the first traveling motor 80A and the second traveling motor 80B are switched to the first speed or the second speed.

The hydraulic system of the traveling system includes a plurality of differential pressure regulation devices (differential pressure regulators) 200. Each of the differential pressure regulation devices 200 includes a differential pressure regulation device (a differential pressure regulator) 200A and a differential pressure regulation device (a differential pressure regulator) 200B. The differential pressure regulation device 200A corresponds to the first traveling hydraulic pump 66A. The differential pressure regulation device 200B corresponds to the second traveling hydraulic pump 66B.

The differential pressure regulation device 200A is configured to supply the pilot fluid to the first hydraulic receiving portion 66*a* and the second hydraulic receiving portion 66*b*. In addition, the differential pressure regulation device 200A sets at least the differential pressure between the pilot pressure (a first pressure DP1) applied to the first hydraulic receiving portion 66*a* and the pilot pressure (a second pressure DP2) applied to the second hydraulic receiving portion 66*b*.

The differential pressure regulation device 200B is configured to supply the pilot fluid to the first hydraulic receiving portion 67*a* and the second hydraulic receiving portion 67*b*. In addition, the differential pressure regulation device 200B sets at least the differential pressure between the pilot pressure (a first pressure EP1) applied to the first hydraulic receiving portion 67*a* and the pilot pressure (a second pressure EP2) applied to the second hydraulic receiving portion 67*b*.

Hereinafter, the differential pressure regulation device will be described taking the differential pressure regulation device 200A as an example.

Meanwhile, the differential pressure regulation device 200A and the differential pressure regulation device 200B are different from each other in the corresponding hydraulic pumps. However, in the explanation of the differential pressure regulation device 200A described below, the explanation of the differential pressure regulation device 200B will be given by replacing the differential pressure regulation device 200A with the differential pressure regulation device 200B.

The differential pressure regulation device 200A includes a first fluid tube 201, a second fluid tube 202, a first proportional valve 211, and a second proportional valve 212.

The first fluid tube 201 is an fluid tube connected to the first hydraulic receiving portion 66*a* of the first traveling hydraulic pump 66A. The second fluid tube 202 is an fluid tube connected to the second hydraulic receiving portion 66*b* of the first traveling hydraulic pump 66A.

The first fluid tube 201 and the second fluid tube 202 are also connected to an fluid tube 77 connected to the second hydraulic pump P2.

Thus, the pilot fluid outputted from the second hydraulic pump P2 through the first fluid tube 201 and the second fluid tube 202 can be supplied to the first hydraulic receiving portion 66*a* and the second hydraulic receiving portion 66*b* of the first traveling hydraulic pump 66A.

The first proportional valve 211 is constituted of an electromagnetic proportional valve provided in the first fluid tube 201, and is configured to change an opening aperture thereof. The second proportional valve 212 is constituted of an electromagnetic proportional valve provided in the second fluid tube 202, and is configured to change an opening aperture thereof.

Thus, the pilot pressure applied to the first hydraulic receiving portion 66*a* of the first traveling hydraulic pump 66A is set by changing the opening aperture of the first proportional valve 211. In addition, the pilot pressure applied to the second hydraulic receiving portion 66*b* of the first traveling hydraulic pump 66A is set by changing the opening aperture of the second proportional valve 212.

The first proportional valve 211 and the second proportional valve 212 set the first pressure and the second pressure on the basis of the operation of the operation member 220. The operating member 220 is constituted of a swingable lever, a slidable slide switch, a pushable push switch, or the like. The operation member 220 is provided in the vicinity of the operator seat 13, and is operated by a driver (an operator).

The operation member 220 is constituted of a member for operating the first traveling hydraulic pump 66A. In the case where the operation member 220 is operated from the neutral position in one direction, the opening aperture of the first proportional valve 211 is increased in accordance with the operation extent of the operation member 220.

In addition, in the case where the operation member 220 is operated from the neutral position to the other direction, the opening aperture of the second proportional valve 212 is increased in accordance with the operation extent of the operation member 220.

Further, in the case where the operation member 220 is operated from the maximum position to the neutral position in one direction, the opening aperture of the first proportional valve 211 is decreased in accordance with the operation extent of the operation member 220.

Moreover, in the case where the operation member 220 is operated from the maximum position to the neutral position in the other direction, the opening aperture of the second proportional valve 212 is decreased in accordance with the operation extent of the operation member 220.

Thus, by operating the operating member 220, it is possible to change the degrees of opening apertures of the first proportional valve 211 and the second proportional valve 212. In this manner, the first pressure DP1 and the second pressure DP2 can be set (regulated).

As the result, the flow rate of the hydraulic fluid outputted from the first traveling hydraulic pump 66A can be adjusted by changing the opening apertures of the first proportional valve 211 and the second proportional valve 212.

Meanwhile, the operations of the first proportional valve 211 and the second proportional valve 212 based on the operation member 220 is the same as the operations of the first proportional valve 171 and the second proportional valve 172 operating based on the operation member 180 described in the first embodiment. Thus, the explanation of the operation will be omitted.

The relation between the first pressure DP1, the second pressure DP2, the differential pressure, and the required pressure is the same as the relation between the first pressure AP1, the second pressure AP2, the differential pressure AP3, and the required pressure AP4 described in the first embodiment. Thus, the explanation of the relationship will be omitted.

In addition, the first proportional valve 211 and the second proportional valve 212 are controlled by the control device 230. The operation of the control device 230 is similar to the operation of the control device 190 described in the first embodiment. Thus, the explanation of the operation will be omitted.

That is, in the explanations of the operation member 180, the first proportional valve 171, the second proportional valve 172, and the control device 190 described in the first embodiment, the description of the first embodiment can be read as the explanations of the configuration of the second embodiment by replacing respectively the operation member 180, the first proportional valve 171, the second proportional valve 172, and the control device 190 with the operating member 220, the first proportional valve 211, the second proportional valve 212, and the control device 230.

According to the present embodiment, the hydraulic device operated by the differential pressure regulation device 200 is a traveling hydraulic pump (the first traveling hydraulic pump 66A, the second traveling hydraulic pump 66B). Thus, the differential pressure regulation device 200 can smoothly operate the traveling hydraulic pump in operating the operation member 220.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In each of the above-described embodiments, a cam motor (a radial piston motor) is exemplified as the traveling motor. However, the traveling motor is not limited to the above-mentioned motor, and may be a piston motor other than a radial piston motor or another type of motor.

What is claimed is:

1. A hydraulic system for a working machine, comprising:

a hydraulic device to change a flow rate and/or a pressure of an operation fluid applied to a hydraulic actuator, the hydraulic device including:

a first hydraulic receiver to which a pilot fluid is applied;

a second hydraulic receiver to which the pilot fluid is applied;

a movable portion to be moved by the pilot fluid applied to any one of the first hydraulic receiver and the second hydraulic receiver;

a differential pressure regulator to supply the pilot fluid to the first hydraulic receiver and the second hydraulic receiver, the differential pressure regulator being configured to regulate a differential pressure between a first pressure that is a pressure of the pilot fluid applied to the first hydraulic receiver and a second pressure that is a pressure of the pilot fluid applied to the second hydraulic receiver; and an operation member, wherein the differential pressure regulator includes:

a first fluid tube connected to the first hydraulic receiver;

a second fluid tube connected to the second hydraulic receiver;

a first proportional valve disposed in the first fluid tube, the first proportional valve being configured to regulate the first pressure; and a second proportional valve disposed in the second fluid tube, the second proportional valve being configured to regulate the second pressure, wherein when an operation extent of the operation member is in a dead zone between zero at a neutral position of the operation member and a predetermined extent greater than zero upon operating the operation member from the neutral position thereof towards a predetermined direction, the first pressure is substantially the same as the second pressure, and when the operation extent of the operation member is beyond the dead zone upon further operating the operation member towards the predetermined direction, the first pressure increases in accordance with the operation extent and the second pressure decreases.

2. The hydraulic system according to claim 1, wherein the hydraulic device includes a control valve having a spool serving as the movable portion, the control valve being configured to change the flow rate and/or the pressure of the operation fluid applied to the hydraulic actuator in accordance with a movement of the spool.

3. The hydraulic system according to claim 1, wherein the hydraulic device includes a hydraulic pump having a cylinder and a swash plate serving as the movable portion, the hydraulic pump being configured to change the flow rate and/or the of the operation fluid in accordance with an angle of the swash plate.

4. The hydraulic system according to claim 1, wherein a required pressure is defined as the minimum differential pressure between the first pressure and the second pressure, which is required for moving the movable portion, and wherein when the operation extent of the operation member is beyond the dead zone exceeds the predetermined extent upon further operating the operation member towards the predetermined direction, the differential pressure between the first pressure and the second pressure is maintained to the required pressure or more.

5. The hydraulic system according to claim 1, wherein when the operation extent of the operation member is beyond the dead zone upon further operating the operation member towards the predetermined direction, the second pressure decreases substantially to zero.

6. A hydraulic system for a working machine, comprising:

a hydraulic device to change a flow rate and/or a pressure of an operation fluid applied to a hydraulic actuator, the hydraulic device including:

a first hydraulic receiver to which a pilot fluid is applied;

a second hydraulic receiver to which the pilot fluid is applied;

a movable portion to be moved by the pilot fluid applied to any one of the first hydraulic receiver and the second hydraulic receiver;

a differential pressure regulator to supply the pilot fluid to the first hydraulic receiver and the second hydraulic receiver, the differential pressure regulator being configured to regulate a differential pressure between a first pressure that is a pressure of the pilot fluid applied to the first hydraulic receiver and a second pressure that is a pressure of the pilot fluid applied to the second hydraulic receiver; and an operation member, wherein the differential pressure regulator includes:

a first fluid tube connected to the first hydraulic receiver;

a second fluid tube connected to the second hydraulic receiver;

a first proportional valve disposed in the first fluid tube, the first proportional valve being configured to regulate the first pressure; and a second proportional valve disposed in the second fluid tube, the second proportional valve being configured to regulate the second pressure, wherein a required pressure is a lowest of the differential pressure, between the first pressure and the second pressure, required for moving the movable portion, wherein when an operation extent of the operation member is in a dead zone between zero at a neutral position of the operation member and a predetermined extent greater than zero upon operating the operation member from the neutral position thereof towards a predetermined direction, the differential pressure between the first pressure and the second pressure is less than the required pressure, and when the operation extent of the operation member is beyond the dead zone upon further operating the operation member towards the predetermined direction, the first pressure increases in accordance with the operation extent and the second pressure decreases.

7. The hydraulic system according to claim 6, wherein when the operation extent of the operation member is beyond the dead zone, the second pressure decreases to substantially zero.

* * * * *